US010082358B2

(12) United States Patent
McPherson

(10) Patent No.: US 10,082,358 B2
(45) Date of Patent: Sep. 25, 2018

(54) COMPOUND BOW WITH HIGH STRING PAYOUT

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 15/351,061

(22) Filed: Nov. 14, 2016

(65) Prior Publication Data

US 2018/0135935 A1 May 17, 2018

(51) Int. Cl.
*F41B 5/10* (2006.01)

(52) U.S. Cl.
CPC ..... *F41B 5/10* (2013.01); *F41B 5/105* (2013.01); *Y10S 124/90* (2013.01)

(58) Field of Classification Search
CPC ..... F41B 5/10; F41B 5/105; F41B 5/0094; F41B 5/12; Y10S 124/90
USPC ..... 124/23.1, 25, 25.6, 900
See application file for complete search history.

(56) References Cited

U.S. PATENT DOCUMENTS 1,192,639 A 7/1916 Hunholz
1,526,176 A 2/1925 O'Connell
1,689,141 A 10/1928 Keller
2,786,461 A 3/1957 Pelsue, Jr.
3,486,495 A 12/1969 Allen
3,851,638 A 12/1974 Alexander
3,923,035 A * 12/1975 Trotter ..... F41B 5/10 124/25.6
3,945,368 A * 3/1976 Jones ..... F41B 5/10 124/25.6
3,958,551 A 5/1976 Ketchum
3,987,777 A 10/1976 Darlington
3,993,039 A * 11/1976 Groves ..... F41B 5/10 124/25.6
4,027,645 A 6/1977 Damron
4,041,927 A 8/1977 Van House
4,077,385 A 3/1978 Fredrickson
4,086,901 A 5/1978 Clement
4,134,383 A 1/1979 Flood
4,169,453 A 10/1979 Hunsicker
4,201,177 A 5/1980 Holman et al.
4,246,883 A 1/1981 Ash
4,261,320 A 4/1981 Barna
4,290,407 A 9/1981 Damron
4,291,664 A 9/1981 Nishioka
4,337,749 A 7/1982 Barna
4,343,286 A 8/1982 Thacker
(Continued)

*Primary Examiner* — Alexander Niconovich

(57) ABSTRACT

In some embodiments, an archery bow comprises a riser and first and second limbs. The first limb supports a first rotatable member, which is arranged to rotate about a first axis. The first rotatable member comprises a bowstring track and a cable track. The second limb supports a second rotatable member, which is arranged to rotate about a second axis. The second rotatable member comprises a bowstring track. A bowstring comprises a first wrapping portion, an intermediate portion and a second wrapping portion. A power cable is arranged to contact the cable track in at least the drawn condition. A separation between the first axis and the second axis in the brace condition is at least 27 inches. A length of the first wrapping portion is at least 52% of a length of the intermediate portion.

19 Claims, 4 Drawing Sheets

(56) References Cited

U.S. PATENT DOCUMENTS 4,385,618 A 5/1983 Niskioka
4,388,914 A 6/1983 Cesin
4,438,753 A 3/1984 Simonds
4,446,844 A 5/1984 Nishioka
4,458,657 A 7/1984 Stockmar
4,461,267 A 7/1984 Simonds et al.
4,478,202 A 10/1984 Anderson
4,512,326 A * 4/1985 Jarrett ..... F41B 5/10 124/25.6
4,649,891 A 3/1987 Bozek
4,651,707 A 3/1987 Bozek
4,693,229 A 9/1987 Nishioka
4,722,317 A * 2/1988 Hartwig ..... F41B 5/10 124/25.6
4,766,874 A 8/1988 Nishioka
4,827,893 A 5/1989 Nishioka
4,903,677 A 2/1990 Colley et al.
4,971,020 A 11/1990 Soderstrom et al.
5,054,463 A * 10/1991 Colley ..... F41B 5/10 124/25.6
5,062,406 A 11/1991 Robertson
5,150,699 A 9/1992 Boissevain
5,205,269 A 4/1993 Guzzetta
5,353,777 A 10/1994 Fincher
5,368,006 A 11/1994 McPherson
5,373,831 A 12/1994 Cushman
5,381,777 A 1/1995 Mitchell et al.
5,503,135 A 4/1996 Bunk
5,638,804 A 6/1997 Remick et al.
5,649,519 A 7/1997 Linderman
5,657,739 A 8/1997 Smith
5,697,355 A 12/1997 Schaffer
5,720,268 A 8/1998 Koltze
5,901,692 A * 5/1999 Allshouse ..... F41B 5/105 124/23.1
5,921,227 A * 7/1999 Allshouse ..... F41B 5/105 124/25.6
5,979,425 A 11/1999 Loomis
5,996,566 A 12/1999 Malan
6,022,660 A 3/2000 Hervig
6,055,974 A 5/2000 Dieziger
6,216,671 B1 4/2001 Dougherty et al.
6,267,108 B1 7/2001 McPherson et al.
6,371,098 B1 * 4/2002 Winther ..... F41B 5/0005 124/23.1
6,651,641 B1 11/2003 Bower et al.
6,698,413 B1 3/2004 Ecklund
6,758,204 B1 * 7/2004 Goff ..... F41B 5/10 124/25.6
6,776,148 B1 * 8/2004 Islas ..... F41B 5/10 124/25.6
6,792,931 B1 9/2004 Schaar
6,990,970 B1 1/2006 Darlington
7,047,958 B1 * 5/2006 Colley ..... F41B 5/10 124/25.6
7,201,161 B1 4/2007 York
7,204,242 B2 * 4/2007 Dziekan ..... F41B 5/12 124/25
7,328,693 B2 2/2008 Kempf
7,347,196 B1 3/2008 Shepley, Jr. et al.
7,363,921 B2 4/2008 Kempf
7,441,555 B1 * 10/2008 Larson ..... F41B 5/10 124/25.6
7,578,289 B2 8/2009 Norkus
7,699,045 B1 * 4/2010 Kronengold ..... F41B 5/10 124/25.6
7,784,452 B1 * 8/2010 Kronengold ..... F41B 5/10 124/23.1
7,823,572 B2 * 11/2010 Anderson ..... F41B 5/123 124/25
7,891,348 B2 * 2/2011 Colley ..... F41B 5/123 124/25
7,980,236 B1 7/2011 Kronengold
8,020,544 B2 9/2011 McPherson
8,056,548 B1 11/2011 Larson
8,079,353 B2 12/2011 Davis et al.
8,281,774 B2 * 10/2012 Grace ..... F41B 5/105 124/25.6
8,360,044 B2 1/2013 Platt
8,387,603 B2 * 3/2013 Darlington ..... F41B 5/10 124/23.1
8,387,604 B1 * 3/2013 Terzo ..... F41B 5/123 124/23.1
8,443,791 B2 5/2013 Miller
8,469,013 B1 6/2013 Yehle
8,627,810 B2 * 1/2014 McPherson ..... F41B 5/10 124/23.1
8,683,989 B1 4/2014 McPherson
9,140,513 B2 * 9/2015 Trpkovski ..... F41B 5/1426
9,273,921 B2 * 3/2016 Koch ..... F41B 5/10
9,297,604 B1 * 3/2016 Sidebottom ..... F41B 5/123
9,513,079 B1 * 12/2016 Missel ..... F41B 5/123
2007/0044782 A1 3/2007 Markus
2007/0101980 A1 * 5/2007 Sims ..... F41B 5/10 124/25.6
2007/0104980 A1 5/2007 Kim et al.
2009/0101126 A1 4/2009 Anderson
2009/0188482 A1 * 7/2009 Strother ..... F41B 5/10 124/25.6
2010/0000504 A1 * 1/2010 Trpkovski ..... F41B 5/0094 124/25.6
2011/0056467 A1 * 3/2011 Popov ..... F41B 5/0094 124/25.6
2011/0203563 A1 8/2011 Platt
2012/0298087 A1 11/2012 Trpkovski
2013/0074819 A1 3/2013 McPherson
2015/0345891 A1 12/2015 McPherson
2017/0122690 A1 * 5/2017 Missel ..... F41B 5/10

* cited by examiner

COMPOUND BOW WITH HIGH STRING PAYOUT

BACKGROUND OF THE INVENTION

This invention relates generally to archery bows and more specifically to compound archery bows. Compound bows typically use rotating cam assemblies, a bowstring and at least one cable. As the bow is drawn, the cam assemblies rotate, feed out bowstring and take up cable. As the cable(s) are taken up, limbs of the bow flex as the cam assemblies are pulled closer together.

As the bow is drawn, multiple factors contribute to movement of the nocking point. Limb flexure and related movement of the center-of-rotation of the cam assemblies provides for some of the nocking point displacement, and the unspooling/feeding-out of bowstring from the rotating cam assemblies provides for some of the nocking point displacement.

Prior art compound bows often included relatively small rotating cam assemblies that feed out small amounts of bowstring. A relatively large amount of the nocking point movement results from limb flexure; however, large changes in bow geometry during draw may not be desirable.

There remains a need for novel compound bow designs that increase efficiency and longevity of the compound bows.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser and first and second limbs. The first limb supports a first rotatable member, which is arranged to rotate about a first axis. The first rotatable member comprises a bowstring track and a cable track. The second limb supports a second rotatable member, which is arranged to rotate about a second axis. The second rotatable member comprises a bowstring track. A bowstring comprises a first wrapping portion, an intermediate portion and a second wrapping portion. A power cable is arranged to contact the cable track in at least the drawn condition. A separation between the first axis and the second axis in the brace condition is at least 27 inches. A length of the first wrapping portion is at least 52% of a length of the intermediate portion.

In some embodiments, a combination of the first wrapping portion length and the second wrapping portion length is greater than the axle/axis separation.

In some embodiments, a combination of the first wrapping portion length and the second wrapping portion length is greater than a powerstroke of the bow.

In some embodiments, the first limb has a working length, and the length of the first wrapping portion is at least twice the working length.

In some embodiments, an axle separation in the drawn condition is at least 90% of the separation in the brace condition.

In some embodiments, an archery bow comprises a riser and first and second limbs. The first limb supports a first rotatable member, which is arranged to rotate about a first axis. The first rotatable member comprises a bowstring track and a cable track. The second limb supports a second rotatable member, which is arranged to rotate about a second axis. The second rotatable member comprises a bowstring track. A bowstring comprises a first wrapping portion, an intermediate portion and a second wrapping portion. A power cable is arranged to contact the cable track in at least the drawn condition. A length of the first wrapping portion combined with a length of the second wrapping portion comprises a total wrapping length. A separation between the first axis and the second axis in the brace condition is at least 27 inches, and the total wrapping length is greater than the separation.

In some embodiments, an archery bow comprises a riser and first and second limbs. The first limb supports a first rotatable member, which is arranged to rotate about a first axis. The first rotatable member comprises a bowstring track and a cable track. The second limb supports a second rotatable member, which is arranged to rotate about a second axis. The second rotatable member comprises a bowstring track. A bowstring comprises a first wrapping portion, an intermediate portion and a second wrapping portion. A power cable is arranged to contact the cable track in at least the drawn condition. The first limb defines a working length between a support point and a supported point. A length of the first wrapping portion is at least twice the working length.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
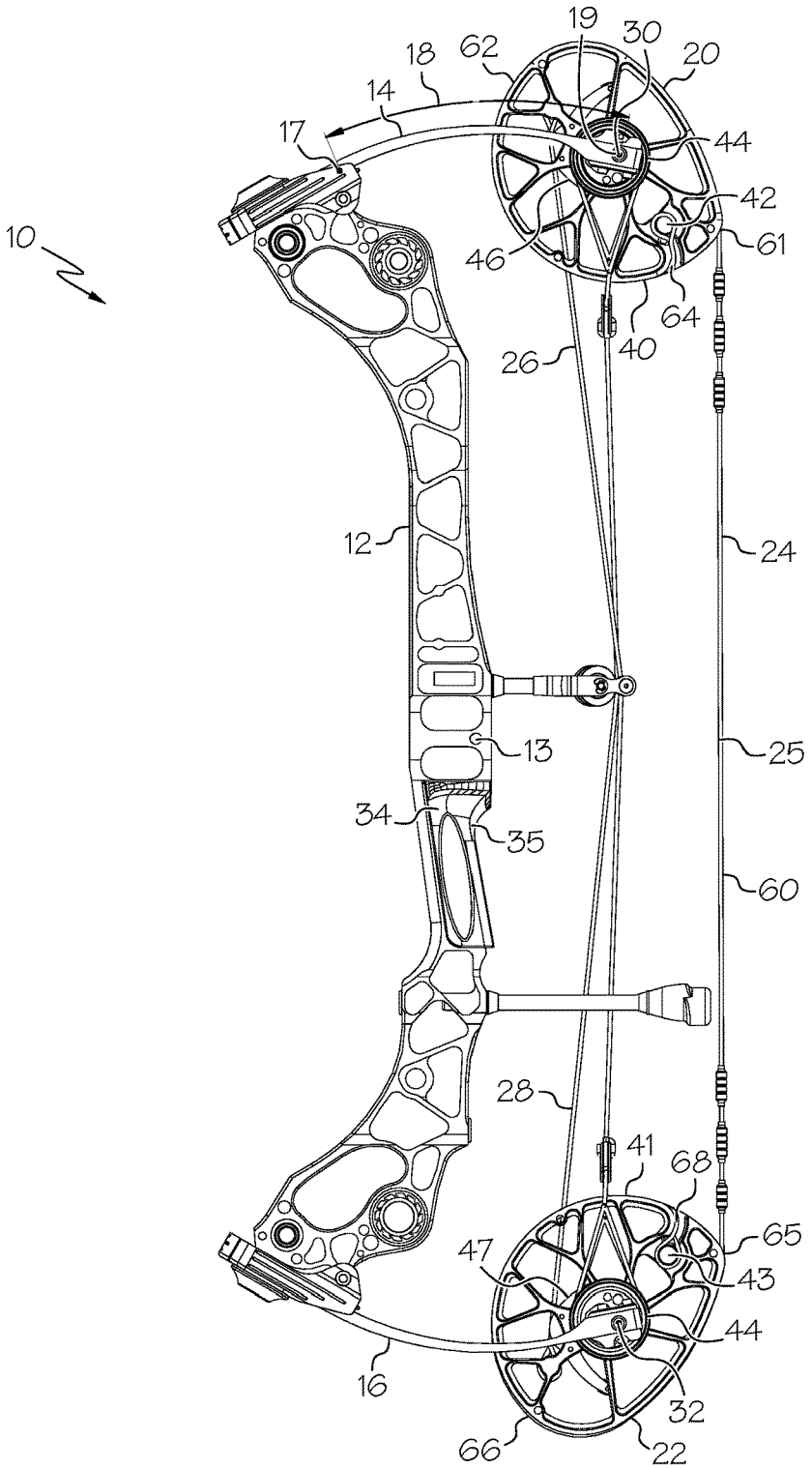
FIG. 1 shows a side view of an embodiment of an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
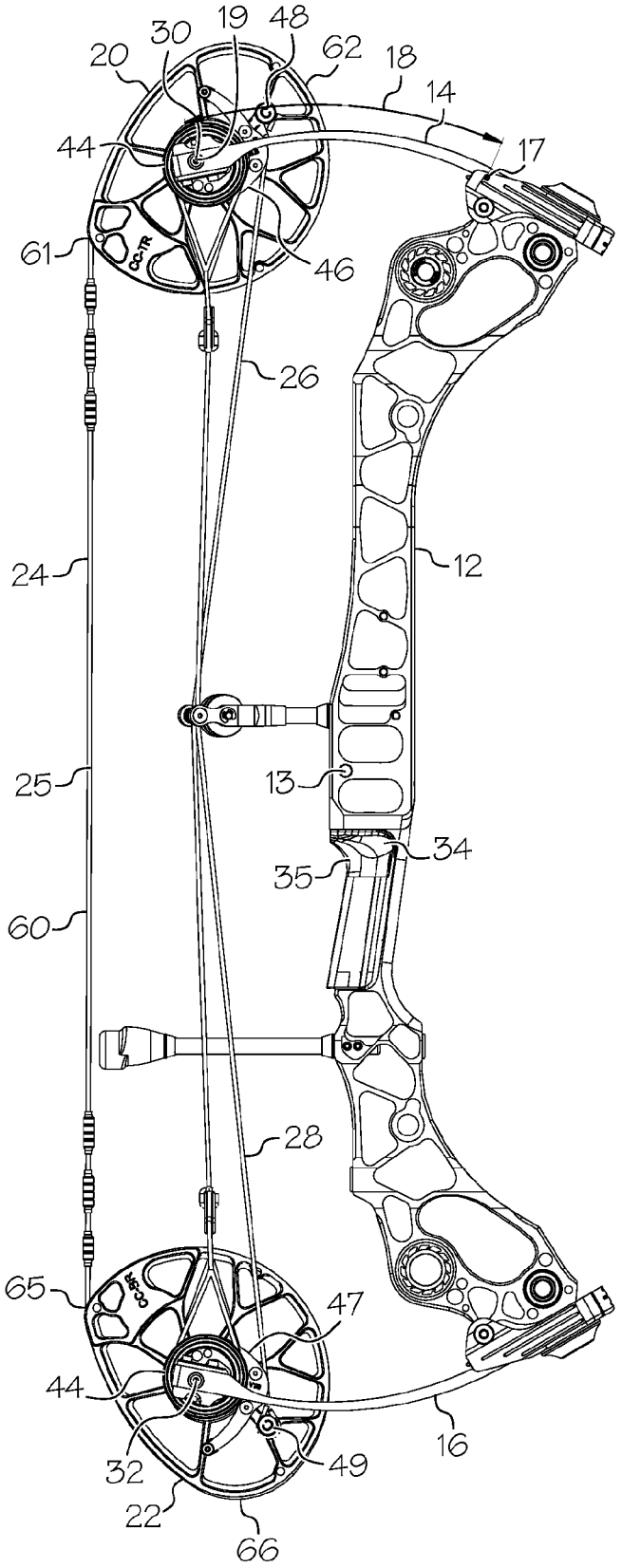
FIG. 2 shows the bow of FIG. 1 from another side.
Figure 3:
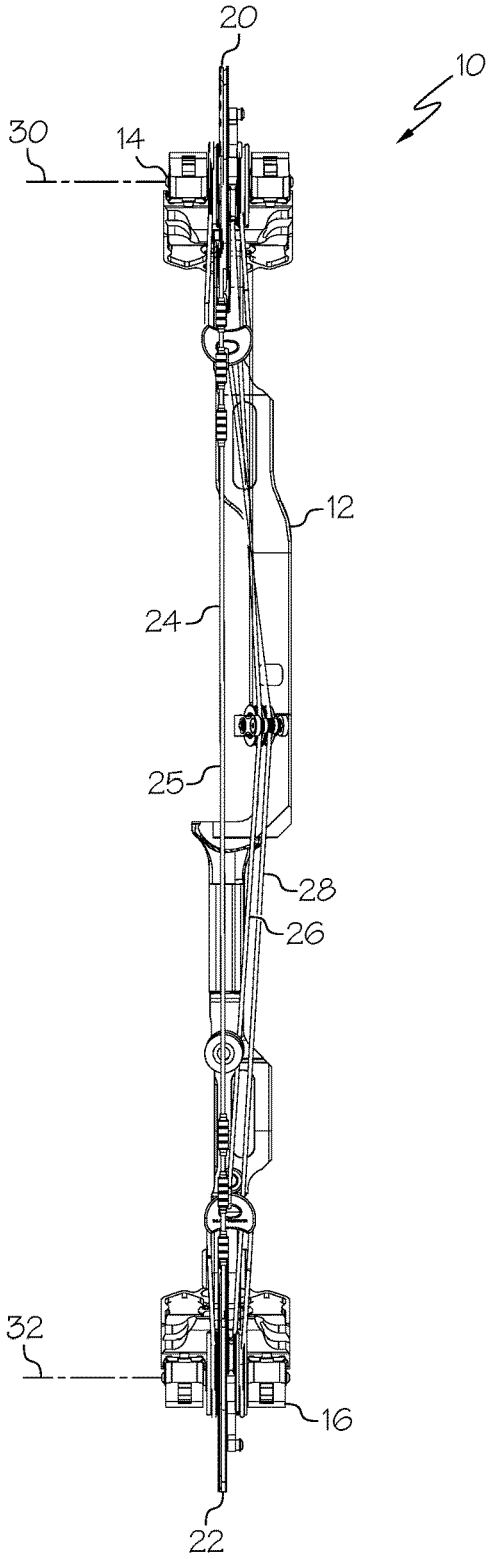
FIG. 3 shows a rear view of the bow of FIG. 1.
Figure 4:
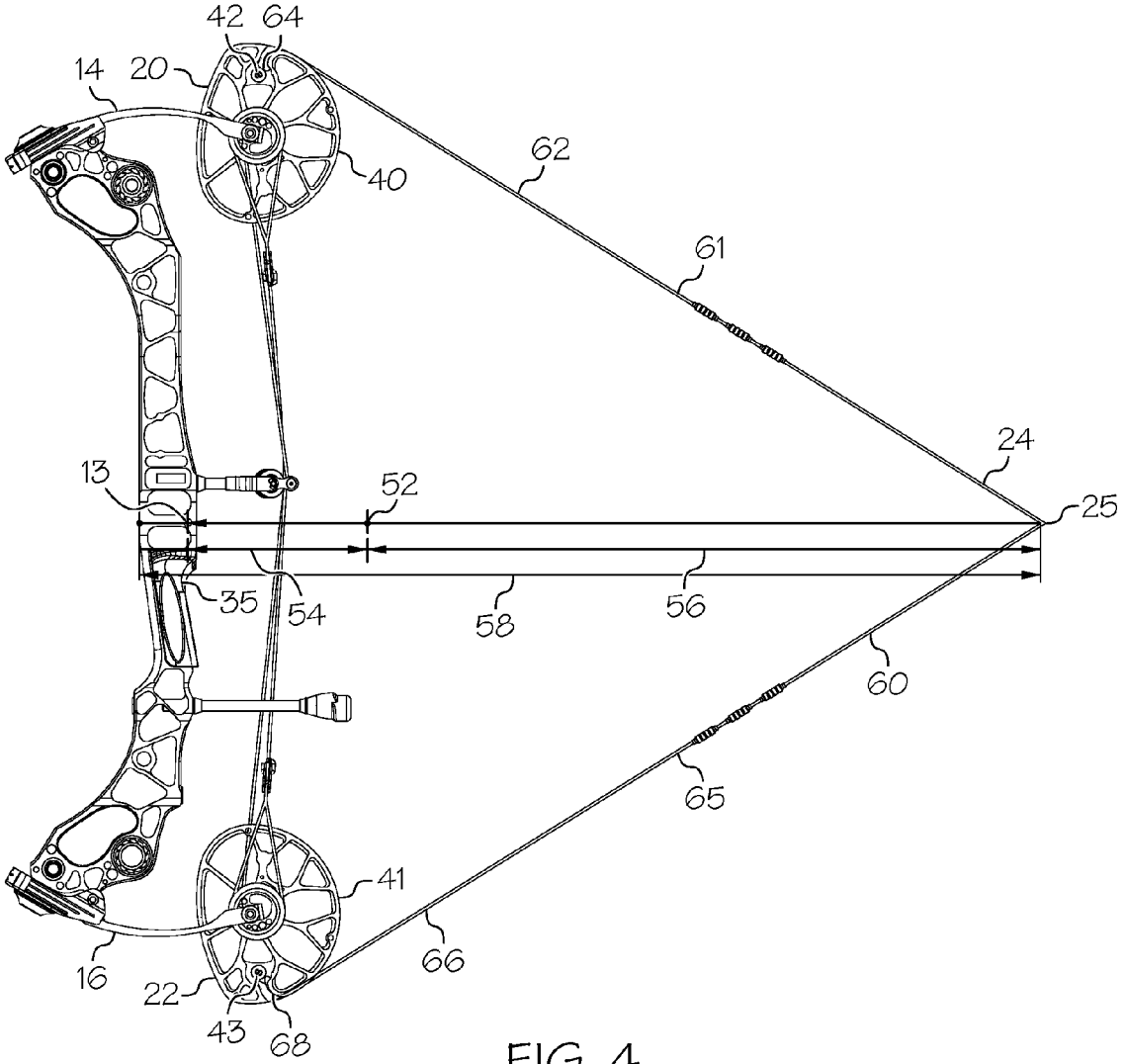
FIG. 4 shows an embodiment of a bow in a drawn configuration.

FIG. 1 shows an embodiment of an archery bow 10 in a brace condition. FIG. 2 shows the archery bow 10 from another side, and FIG. 3 shows a view of the bow 10 from an archer's perspective. FIG. 4 shows the bow 10 in a drawn configuration.

In some embodiments, an archery bow 10 comprises a riser 10, a first limb 14 supporting a first rotatable member 20, and a second limb 16 supporting a second rotatable member 22. The first rotatable member 20 is arranged to rotate about a first axis 30. In some embodiments, the first rotatable member 20 is supported by an axle. The second rotatable member 22 is arranged to rotate about a second axis 32. In some embodiments, the second rotatable member 22 is supported by an axle. Desirably, a bowstring 24 extends between the rotatable members 20, 22. In some embodiments, the first rotatable member 20 comprises a bowstring track 40 and a bowstring terminal 42. In some embodiments, the second rotatable member 22 comprises a bowstring track 41 and a bowstring terminal 43.

Desirably, the first rotatable member 20 comprises a cable track 46 that comprises a cam with respect to the first axis 30. Desirably, the bow 10 comprises a first power cable 26 that is arranged to be taken up on the cable track 46 as the bow 10 is drawn.

In some embodiments, a bow 10 comprises a single cam bow (not illustrated) having single power cable. In some such embodiments, the bowstring can wrap around a second rotatable member and return to the first rotatable member as a control cable portion. In some other such embodiments, the bowstring can terminate on the second rotatable member and a separate control cable segment can attach to the second rotatable member and return to the first rotatable member.

As illustrated herein, in some embodiments, the bow 10 comprises a two-cam bow. For example, the second rotatable member 22 can comprise a second cable track 47, and the bow 10 can comprise a second power cable 28 that is arranged to be taken up on the second cable track 47 as the bow 10 is drawn.

In some embodiments, each power cable 26, 28 terminates at one end on a cable terminal 48, 49, and attaches at the other end to a location of the bow 10, such as an axle, limb or a rotatable member. In some embodiments, the end of a power cable 26, 28 attaches to a force vectoring anchor 44, for example as described in U.S. Pat. No. 8,020,544, the entire disclosure of which is hereby incorporated herein by reference.

Desirably, the bow 10 comprises a grip 34. In some embodiments, the grip 34 defines a pivot point 35 for the bow 10. In some embodiments, a distance between the pivot point 35 and the bowstring 24 in the brace condition is the brace height. In some embodiments, the riser 12 defines a Berger button or an arrow rest aperture 13. In some embodiments, the bowstring 24 defines a nocking point 25. In some embodiments, a distance between the arrow rest aperture 13 and the nocking point 25 in the brace condition is the brace height.

The bow illustrated in FIG. 1 has a brace height of 6 inches. In other embodiments, a brace height can be 5 inches, 7 inches, or 8 inches. In some embodiments, a brace height can have any value between 5 inches and 8 inches.

Desirably, a bow 10 defines a distance between the first axis 30 and the second axis 32. In some embodiments, the bow 10 defines an axle-to-axle distance. In some embodiments, an axle-to-axle distance is 27 inches or greater. In some embodiment, an axle-to-axle can have any value ranging from 27 inches to over 40 inches. Common axle-to-axle ranges for hunting bows can be in the range of 28 inches, 29 inches, 30 inches, 31 inches, 32 inches and 33 inches. An axle-to-axle distance is typically specified in the brace condition of the bow 10.

A limb 14, 16 generally defines a length. A limb 14, 16 desirably defines a working length 18 that acts as a cantilever between a supported point 17 and a loading point 19. In some embodiments, a supported point 17 comprises a fulcrum or last support point for a force reaction provided by the riser 12, or by a limb cup. In some embodiments, the loading point 19 comprises a location where loading from a rotatable member 20 is applied to the limb 14. A limb 14 can have any suitable working length 18. In some embodiments, a working length 18 of a limb is 4 inches, 4.5 inches, 5 inches, 5.5 inches, 6 inches, 6.5 inches, 7 inches, 7.5 inches, 8 inches or more. As shown in FIG. 1, the limb 14 comprises a working length 18 of 6.5 inches.

In some embodiments, the bowstring 24 comprises a plurality of portions along its length. In some embodiments, the bowstring 24 comprises a first terminal portion 64, a first wrapping portion 62, an intermediate portion 60, a second wrapping portion 66 and a second terminal portion 68. A first transition 61 is indicated between the first wrapping portion 62 and the intermediate portion 60, and a second transition 65 is indicated between the second wrapping portion 66 and the intermediate portion 60.

Desirably, the intermediate portion 60 comprises a portion of bowstring 24 that extends between the rotatable members 20, 22 in the brace condition. The last contact points of the bowstring 24 on a rotatable member 20, 22, which are also characterized as transitions 61, 65 herein, define endpoints of the intermediate portion 60. Desirably, the intermediate portion 60 includes the nocking point 25. Desirably, the intermediate portion 60 does not contact or become wrapped in any bowstring track 40, 41.

Desirably, the first wrapping portion 62 comprises a portion of bowstring 24 that is oriented in the bowstring track 40 of the first rotatable member 20 in the brace condition. During draw, the first wrapping portion 62 unwraps from the first rotatable member 20. Desirably, in the drawn condition (see FIG. 4), the first wrapping portion 62 is spaced apart from the first rotatable member 20 and extends between the intermediate portion 60 and the first rotatable member 20. Desirably, the first terminal portion 64 is attached to the first bowstring terminal 42. Desirably, the first terminal portion 64 contacts the first rotatable member 20 in both the brace and drawn conditions.

Desirably, the second wrapping portion 66 comprises a portion of bowstring 24 that is oriented in the bowstring track 41 of the second rotatable member 22 in the brace condition. During draw, the second wrapping portion 66 unwraps from the second rotatable member 22. Desirably, in the drawn condition (see FIG. 4), the second wrapping portion 66 is spaced apart from the second rotatable member 22 and extends between the intermediate portion 60 and the second rotatable member 22. Desirably, the second terminal portion 68 is attached to the second bowstring terminal 43. Desirably, the second terminal portion 68 contacts the second rotatable member 22 in both the brace and drawn conditions.

When a bow 10 is configured to have relatively large wrapping portions 62, 66 as compared to other portions of the bow 10, nocking point 25 movement can be provided by cable unwrapping as opposed to axle movement. A bow 10 having a high amount of wrapping portions 62, 66 can have a smaller degree of axle movement during draw.

In some embodiments, the total distance defined by the two bowstring wrapping portions 62, 66 is greater than a distance between the first axis 30 and second axis 32 (e.g.

axle separation). In some embodiments, a length of the first wrapping portion 62 is at least 50% of the axle separation. In some embodiments, a length of the first wrapping portion 62 is at least 52% of the axle separation in the brace condition. In some embodiments, a length of the first wrapping portion 62 is at least 54% of the axle separation in the brace condition. In some embodiments, a length of the first wrapping portion 62 is at least 56% of the axle separation in the brace condition.

As shown in FIG. 4, reference character 52 indicates the location of the nocking point 25 when the bow 10 is in the brace condition. A brace height distance 54 is indicated. A distance of nocking point travel 56 during draw is also indicated. The distance of nocking point travel 56 during draw can also be described as the powerstroke 56.

FIG. 4 also indicates a draw length 58 of the bow 10. In some embodiments, the draw length 58 is the standard ATA draw length. In some embodiments, the draw length 58 is equal to the powerstroke 56 plus the brace height 54 plus 1.75 inches.

Desirably, a bow 10 reaches its draw length when the bowstring holding force reaches "let-off," for example creating a valley in the draw force curve.

The bow 10 shown in FIG. 4 has a draw length of 31 inches.

In various embodiments, a bow 10 can have a draw length 58 ranging from 25 inches to 32 inches or more. Bows 10 are often provided with draw length adjustment in 0.5" steps.

In some embodiments, the powerstroke 56 is approximately 23.25 inches. In some embodiments, the powerstroke 56 can range from 17 inches to 26 inches or more.

In some embodiments, the intermediate portion 60 of the bowstring 24 has a length of at least 26.5 inches. In some embodiments, the intermediate portion 60 has a length of 26 inches, 27 inches, 27.5 inches, 28 inches, 28.5 inches or more.

In some embodiments, the first wrapping portion 62 has a length of at least 15 inches. In some embodiments, the second wrapping portion 66 has a length of at least 15 inches. In some embodiments, each wrapping portion 62, 66 has a length of 15.25 inches, 15.5 inches, 15.75 inches, 16 inches or more.

In some embodiments, a sum of lengths of the wrapping portions 62 exceeds the powerstroke 56.

In some embodiments, a length of the first wrapping portion 62 is at least 50% of the length of the intermediate portion 60. In some embodiments, a length of the first wrapping portion 62 is at least 52% of the length of the intermediate portion 60. In some embodiments, a length of the first wrapping portion 62 is at least 54% of the length of the intermediate portion 60.

In some embodiments, a length of the first wrapping portion 62 is at least twice the working length 18 of a limb 14. In some embodiments, a length of the first wrapping portion 62 is at least 2.1 times the working length 18 of a limb 14. In some embodiments, a length of the first wrapping portion 62 is at least 2.2 times the working length 18 of a limb 14. In some embodiments, a length of the first wrapping portion 62 is at least 2.3 times the working length 18 of a limb 14.

In some embodiments, a distance between the first axis 30 and the second axis 32 in the brace condition is 30 inches. In some embodiments, an axle-to-axle distance for the bow 10 is 30 inches. In some embodiments, a distance between the first axis 30 and the second axis 32 in the brace condition can have any value ranging from 28 inches to 34 or more inches.

In some embodiments, a distance between the first axis 30 and the second axis 32 in the drawn condition is at least 90% of such distance in the brace condition. In some embodiments, a distance between the first axis 30 and the second axis 32 in the drawn condition is at least 92% of such distance in the brace condition. In some embodiments, a distance between the first axis 30 and the second axis 32 in the drawn condition is at least 94% of such distance in the brace condition. In some embodiments, a distance between the first axis 30 and the second axis 32 in the drawn condition is at least 96% of such distance in the brace condition.

In some embodiments, a distance between the first axis 30 and the second axis 32 in the drawn condition In some embodiments, each rotatable member 20, 22 rotates up to 310 degrees as the bow 10 is drawn from brace condition to full draw.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An archery bow having a brace condition and a drawn condition, the archery bow comprising:

a riser;

a first limb supporting a first rotatable member, the first rotatable member arranged to rotate about a first axis, the first rotatable member comprising a first bowstring track and a cable track;

a second limb supporting a second rotatable member, the second rotatable member arranged to rotate about a second axis, the second rotatable member comprising a second bowstring track;

a bowstring having a first wrapping portion, an intermediate portion and a second wrapping portion, the first wrapping portion oriented in the first bowstring track and the second wrapping portion oriented in the second bowstring track when the bow is in the brace condition;

a cable arranged to contact the cable track in at least the drawn condition;

wherein a separation between the first axis and the second axis in the brace condition is at least 27 inches and a length of the first wrapping portion is at least 52% of a length of the intermediate portion.

2. The archery bow of claim 1, wherein a combination of the first wrapping portion length and the second wrapping portion length is greater than said separation.

3. The archery bow of claim 2, wherein said separation is at least 30 inches.

4. The archery bow of claim 1, wherein a combination of the first wrapping portion length and the second wrapping portion length is greater than a powerstroke length.

5. The archery bow of claim 1, the first limb having a working length, the length of the first wrapping portion being at least twice the working length.

6. The archery bow of claim 1, the first limb having a working length, the length of the first wrapping portion being at least 2.3 times the working length.

7. The archery bow of claim 1, wherein a separation in the drawn condition is at least 90% of said separation in the brace condition.

8. The archery bow of claim 1, wherein a separation in the drawn condition is at least 92% of said separation in the brace condition.

9. An archery bow having a brace condition and a drawn condition, the archery bow comprising:

a riser;

a first limb supporting a first rotatable member, the first rotatable member arranged to rotate about a first axis, the first rotatable member comprising a first bowstring track and a cable track;

a second limb supporting a second rotatable member, the second rotatable member arranged to rotate about a second axis, the second rotatable member comprising a second bowstring track;

a bowstring having a first wrapping portion, an intermediate portion and a second wrapping portion, the first wrapping portion oriented in the first bowstring track and the second wrapping portion oriented in the second bowstring track when the bow is in the brace condition, a length of the first wrapping portion combined with a length of the second wrapping portion comprising a total wrapping length;

a cable arranged to contact the cable track in at least the drawn condition;

wherein a separation between the first axis and the second axis in the brace condition is at least 27 inches and the total wrapping length is greater than said separation.

10. The archery bow of claim 9, wherein the separation is at least 30 inches.

11. The archery bow of claim 9, wherein said total wrapping length is greater than a length of said intermediate portion.

12. The archery bow of claim 9, said first limb having a working length, a length of said first wrapping portion being at least twice a length of the first wrapping portion.

13. The archery bow of claim 9, wherein said total wrapping length is greater than a powerstroke of the bow.

14. The archery bow of claim 9, wherein a separation between the first axis and the second axis in the drawn condition is at least 90% of said separation in the brace condition.

15. An archery bow having a brace condition and a drawn condition, the archery bow comprising:

a riser;

a first limb supporting a first rotatable member, the first rotatable member arranged to rotate about a first axis, the first rotatable member comprising a first bowstring track and a cable track, the first limb comprising a working length defined between a support point and a supported point;

a second limb supporting a second rotatable member, the second rotatable member arranged to rotate about a second axis, the second rotatable member comprising a second bowstring track;

a bowstring having a first wrapping portion, an intermediate portion and a second wrapping portion, the first wrapping portion oriented in the first bowstring track and the second wrapping portion oriented in the second bowstring track when the bow is in the brace condition;

a cable arranged to contact the cable track in at least the drawn condition;

wherein a length of the first wrapping portion is at least twice the working length.

16. The archery bow of claim 15, wherein a length of the first wrapping portion is at least 2.2 times the working length.

17. The archery bow of claim 15, wherein a length of the first wrapping portion is at least 52% of a length of the intermediate portion.

18. The archery bow of claim 15, wherein a separation between the first axis and the second axis in the drawn condition is at least 90% of said separation in the brace condition.

19. The archery bow of claim 15, wherein a length of the first wrapping portion combined with a length of the second wrapping portion is greater than a separation between the first axis and the second axis in the brace condition.

* * * * *